US011721254B1

(12) United States Patent
Zhang et al.

(10) Patent No.: US 11,721,254 B1
(45) Date of Patent: Aug. 8, 2023

(54) METHOD FOR ELIMINATING HORIZONTAL CROSSTALK AND SYSTEM FOR ADJUSTING COMMON ELECTRODE VOLTAGE

(71) Applicants: MIANYANG HKC OPTOELECTRONICS TECHNOLOGY CO., LTD., Sichuan (CN); HKC CORPORATION LIMITED, Shenzhen (CN)

(72) Inventors: Jianying Zhang, Sichuan (CN); Haijiang Yuan, Sichuan (CN)

(73) Assignees: MIANYANG HKC OPTOELECTRONICS TECHNOLOGY CO., LTD., Mianyang (CN); HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/087,957

(22) Filed: Dec. 23, 2022

(30) Foreign Application Priority Data

Mar. 26, 2022 (CN) ..... 202210304424.1

(51) Int. Cl.
*G09G 3/00* (2006.01)

(52) U.S. Cl.
CPC ..... *G09G 3/006* (2013.01); *G09G 2310/08* (2013.01); *G09G 2320/0209* (2013.01); *G09G 2320/0233* (2013.01); *G09G 2320/0247* (2013.01); *G09G 2320/0276* (2013.01); *G09G 2360/16* (2013.01)

(58) Field of Classification Search
CPC ..... G09G 3/006
See application file for complete search history.

(56) References Cited

U.S. PATENT DOCUMENTS

2020/0365090 A1 11/2020 Yoon et al.

FOREIGN PATENT DOCUMENTS

| | | | |
|---|---|---|---|
| CN | 104698638 | A | 6/2015 |
| CN | 105812784 | A | 7/2016 |
| CN | 106683603 | A | 5/2017 |
| CN | 108597428 | A | 9/2018 |
| CN | 108630165 | A | 10/2018 |
| CN | 109712584 | A | 5/2019 |
| CN | 113674710 | A | 11/2021 |

*Primary Examiner* — Gustavo Polo
(74) *Attorney, Agent, or Firm* — Hauptman Ham, LLP

(57) ABSTRACT

A method for eliminating horizontal crosstalk and a system for adjusting a common electrode voltage are provided. The method for eliminating the horizontal crosstalk includes the followings. First brightness values of a first test image corresponding to different common electrode voltages, second brightness values of a second test image corresponding to different common electrode voltages, and flicker values of a third test image corresponding to different common electrode voltages are obtained respectively. A brightness difference between a corresponding first brightness value and a corresponding second brightness value is calculated and a first-difference common electrode voltage corresponding to a minimum difference is obtained. A second-difference common electrode voltage corresponding to a minimum flicker value is obtained. A mean of the first-difference common electrode voltage and the second-difference common electrode voltage is taken as a target common electrode voltage.

20 Claims, 6 Drawing Sheets

METHOD FOR ELIMINATING HORIZONTAL CROSSTALK AND SYSTEM FOR ADJUSTING COMMON ELECTRODE VOLTAGE

CROSS-REFERENCE TO RELATED APPLICATIONS

This application claims priority under 35 U.S.C. § 119(a) to Chinese Patent Application No. 202210304424.1, filed Mar. 26, 2022, the entire disclosure of which is incorporated herein by reference.

TECHNICAL FIELD

This disclosure relates to the field of display technology, and in particular to a method for eliminating horizontal crosstalk, a system for adjusting a common electrode voltage, and a display device.

BACKGROUND

Thin Film Transistor-Liquid Crystal Displays (TFT-LCDs) have many advantages such as thin body, power saving, no radiation, and the like, so the TFT-LCDs are widely applied to electronic devices such as a liquid crystal television, a mobile phone, a Personal Digital Assistant (PDA), a digital camera, a computer screen, a projector, a notebook computer screen, and the like, and the TFT-LCDs play leading roles in the display field. The TFT-LCD is generally provided with a common electrode and a pixel electrode, and liquid crystal molecules can be controlled to deflect to different degrees by adjusting an electric field between the common electrode and the pixel electrode, such that a display panel displays images with different grayscales.

However, in the related art, since parasitic capacitance often exists between a data line and the common electrode, when a voltage of the data line changes, the parasitic capacitance is coupled with the common electrode, such that a common electrode voltage is affected, a display image on the TFT-LCD is prone to horizontal crosstalk, thereby reducing display effect and quality of the display image and affecting display reliability of the display panel.

SUMMARY

In a first aspect, a method for eliminating horizontal crosstalk is provided in the present disclosure. The method includes the following. A corresponding first test image is displayed according to a first-test-image signal, and first brightness values of the first test image are obtained at different common electrode voltages respectively. A corresponding second test image is displayed according to a second-test-image signal, and second brightness values of the second test image are obtained at different common electrode voltages respectively. For each common electrode voltage, a brightness difference between a corresponding first brightness value and a corresponding second brightness value is calculated to obtain a minimum brightness difference, and a corresponding first-difference common electrode voltage is obtained according to the minimum brightness difference. A corresponding third test image is displayed according to a third-test-image signal, flicker values of the third test image are obtained at different common electrode voltages respectively, and a common electrode voltage corresponding to a minimum flicker value among multiple flicker values is obtained as a second-difference common electrode voltage. A mean of the first-difference common electrode voltage and the second-difference common electrode voltage is calculated to obtain a target common electrode voltage.

In a second aspect, a system for adjusting a common electrode voltage is further provided in the present disclosure and for eliminating horizontal crosstalk of a display device. The system for adjusting the common electrode voltage includes an image generation subsystem, an optical metrology subsystem, and a computer terminal. The image generation subsystem is electrically connected with the computer terminal and the display device, and is configured to receive a test-image signal from the computer terminal and transmit the test-image signal received to the display device. The test-image signal includes a first test-image signal, a second test-image signal, and a third test-image signal. The display device is configured to receive the test-image signal, display a corresponding first test image according to the first test-image signal, display a corresponding second test image according to the second test-image signal, display a corresponding third test image according to the third test-image signal. The optical metrology subsystem is electrically connected with the computer terminal, and is configured to obtain first brightness values of the first test image at different common electrode voltages respectively, obtain second brightness values of the second test image at different common electrode voltages respectively, and flicker values of the third test image at different common electrode voltages respectively, and send the first brightness values, the second brightness values, and the flicker values to the computer terminal. The computer terminal is configured to receive the first brightness values, the second brightness values, and the flicker values sent by the optical metrology subsystem. For each common electrode, the computer terminal is configured to calculate a brightness difference between a corresponding first brightness value and a corresponding second brightness value to obtain a minimum brightness difference. The computer terminal is configured to obtain a first-difference common electrode voltage according to the minimum brightness difference. The computer terminal is configured to obtain a common electrode voltage corresponding to a minimum flicker value among multiple flicker values as a second-difference common electrode voltage. The computer terminal is configured to calculate a mean of the first-difference common electrode voltage and the second-difference common electrode voltage to obtain a target common electrode voltage of the display device.

In a third aspect, a display device is further provided in the present disclosure. The display device includes a display panel and a backlight assembly. The display panel is mounted at a light-existing side of the backlight assembly. The backlight assembly is configured to provide backlights for the display panel. The display device is configured to display a corresponding first test image according to a first-test-image signal, and obtain first brightness values of the first test image at different common electrode voltages respectively; configured to display a corresponding second test image according to a second-test-image signal, and obtain second brightness values of the second test image at different common electrode voltages respectively; for each common electrode voltage, calculate a brightness difference between a corresponding first brightness value and a corresponding second brightness value to obtain a minimum brightness difference, and obtain a corresponding first-difference common electrode voltage according to the minimum brightness difference; display a corresponding third test image according to a third-test-image signal, obtain flicker values of the third test image at different common electrode voltages respectively, and obtain a common electrode voltage corresponding to a minimum flicker value among multiple flicker values as a second-difference common electrode voltage; and calculate a mean of the first-difference common electrode voltage and the second-difference common electrode voltage to obtain a target common electrode voltage, to determine a common electrode voltage for driving the display panel.

Figure 1:
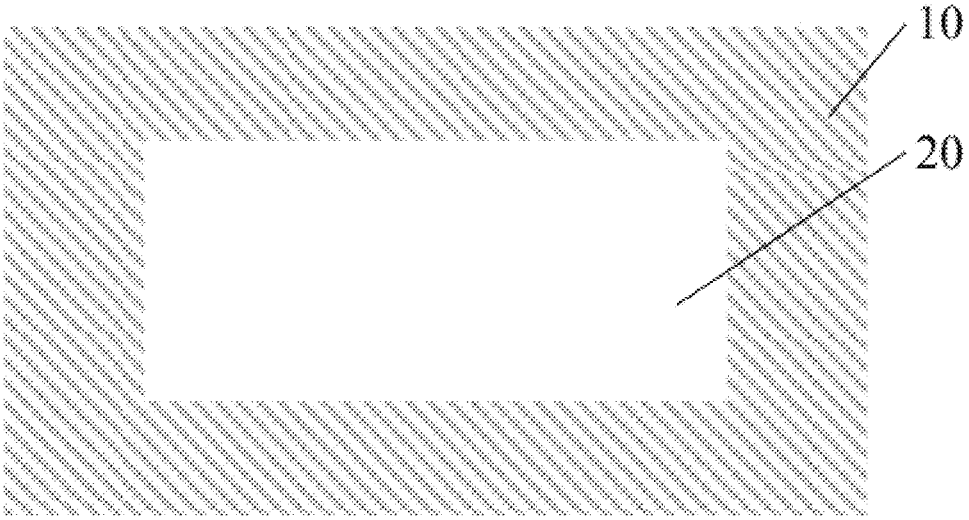
FIG. 1 is a schematic diagram of a display panel of a display device normally displaying an image disclosed in the present disclosure.

Reference signs: 100—*a* system for adjusting a common electrode voltage, 10—first display region, 20—second display region, 30—horizontal crosstalk, 110—image generation subsystem, 111—light-on apparatus, 113—time schedule controller, 130—optical metrology subsystem, 131—optical probe, 133—optical testing instrument, 150—computer terminal, 170—debugger adapter board, 200—display device, 210—display panel, 212—first test point, 213—first test region, 214—second test point, 216—second test region, 220—backlight assembly, S10-S60—blocks of a method for eliminating horizontal crosstalk, S11-S14—blocks of a method for eliminating horizontal crosstalk at S10, S21-S24—blocks of a method for eliminating horizontal crosstalk at S20, S41-S45—blocks of a method for eliminating horizontal crosstalk at S40.

DETAILED DESCRIPTION

In order to facilitate understanding of the present disclosure, a comprehensive description will be given below with reference to relevant accompanying drawings. The accompanying drawings illustrate some exemplary implementations of the present disclosure. However, the present disclosure can be implemented in many different forms and is not limited to implementations described herein. On the contrary, these implementations are provided for a more thorough and comprehensive understanding of the present disclosure.

The following implementations are described with reference to additional drawings to illustrate particular implementations in which the present disclosure may be implemented. The serial numbers assigned herein for the components themselves, such as "first", "second", etc., are only used to distinguish between objects described and do not have any sequential or technical meaning. The "connection" and "coupling" in present disclosure, unless otherwise specified, include direct and indirect connection (coupling). Direction terms mentioned in present disclosure, such as "up", "down", "front", "back", "left", "right", "inside", "outside", "side", etc., are only directions with reference to the directions of the accompanying drawings. Therefore, the direction terms are used for better and clearer illustration and understanding of the present disclosure, and are not intended to indicate or imply that the device or component must have a specific orientation, be constructed and operated in the particular orientation, and therefore cannot be construed as limiting to the present disclosure.

In the description of the present disclosure, it should be noted that unless otherwise expressly specified or defined, terms such as "mounting", "installing", "coupling", "connecting" should be understood broadly. For example, coupling may be a fixed coupling, or a detachable coupling, or an integrated coupling; may be a mechanical coupling; and may be a direct coupling, an indirect coupling through a medium, or a communication coupling between two components. The specific meanings of the above-mentioned terms in the present disclosure could be understood by those of ordinary skill in the art according to specific situations. It should be noted that the terms "first", "second", etc. in the description, claims and accompanying drawings of the present disclosure are used to distinguish different objects, rather than to describe a specific order.

In the field of display technology, a display device may generally include a display panel and a backlight assembly. The display panel is mounted at a light-exiting side of the backlight assembly, and the backlight assembly can adjust the display panel to display different images. In a Thin Film Transistor-Liquid Crystal Display (TFT-LCD), the backlight assembly is provided with a common electrode, a pixel electrode, a data line, and liquid crystal molecules. A common electrode voltage is a reference voltage. A magnitude of a data signal of the data line is changed to make the pixel electrode release capacitance in different degrees, resulting in electric fields of different magnitudes between the common electrode and the pixel electrode. The electric fields of different magnitudes control the liquid crystal molecules in the backlight assembly to deflect in different degrees, such that the display panel displays different grayscale images.

Figure 2:
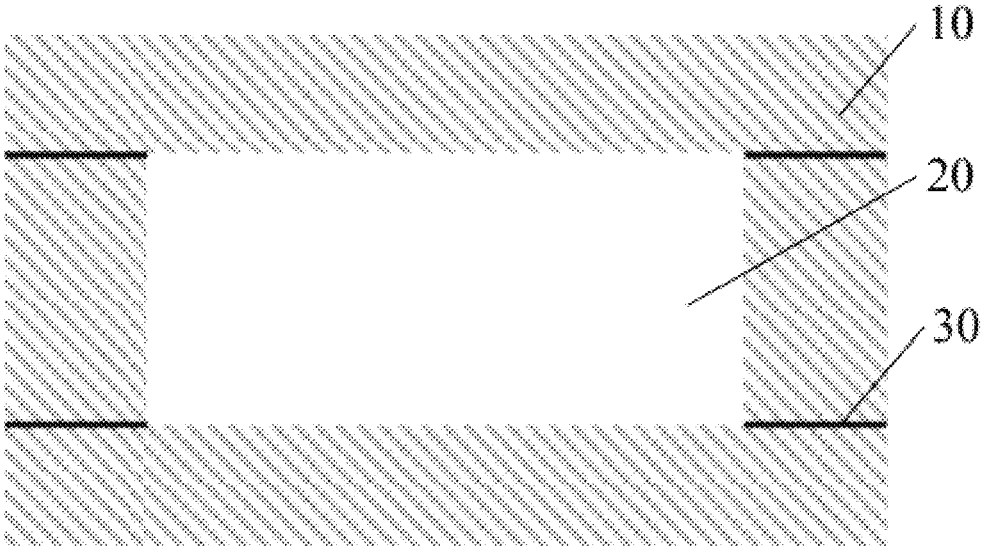
FIG. 2 is a schematic diagram of a display panel of a display device displaying an image with horizontal crosstalk disclosed in the present disclosure.

Reference can be made to FIG. 1 and FIG. 2, where FIG. 1 is a schematic diagram of a display panel of a display device normally displaying an image disclosed in the present disclosure, and FIG. 2 is a schematic diagram of a display panel of a display device displaying an image with horizontal crosstalk disclosed in the present disclosure. As illustrated in FIG. 1 and FIG. 2, the display panel provided in implementations of the present disclosure has a first display region 10 and a second display region 20, and the first display region 10 is disposed around a peripheral side of the second display region 20. The first display region 10 is used to display a first grayscale image, and the second display region 20 is used to display a second grayscale image, where the first grayscale image and the second grayscale image have different grayscale values. For example, a grayscale value of the first grayscale image may be any value between 63 and 127, and a grayscale value of the second grayscale image may be 255.

In other implementations of the present disclosure, the grayscale value of the first grayscale image may be 255, and the grayscale value of the second grayscale image may be any value between 63 and 127.

It should be noted that different grayscale values correspond to different magnitudes of the electric fields between the pixel electrode and the common electrode, that is, different grayscale values correspond to different magnitudes of the data signals. Therefore, parasitic capacitance will be generated due to voltage differences among different electric fields corresponding to different grayscale values. When the data signal (i.e., data line voltage) changes, the parasitic capacitance is coupled with the common electrode, such that the common electrode voltage is changed. Furthermore, deflection angles of the liquid crystal molecules are affected, such that an error occurs in brightness display of the display panel, that is, horizontal crosstalk (linear Mura) 30 occurs as illustrated in FIG. 2, which greatly reduces display effect and quality of the display panel, and further affects display reliability of the display panel.

In order to facilitate understanding of a method for eliminating horizontal crosstalk disclosed in implementations of the present disclosure, a system for adjusting a common electrode voltage provided in implementations of the present disclosure is first introduced below.

Figure 3:
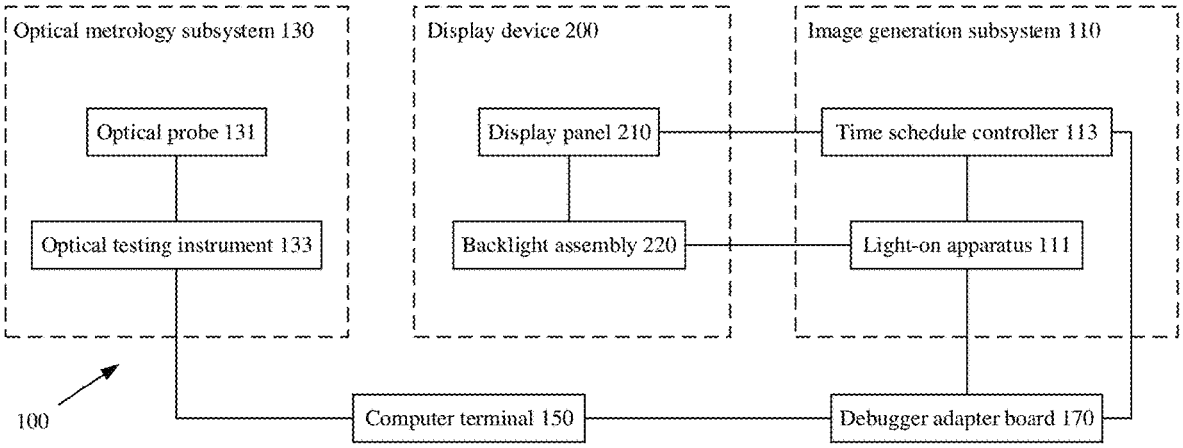
FIG. 3 is a schematic diagram of a connection relationship of a system for adjusting a common electrode voltage disclosed in the present disclosure.
Figure 4:
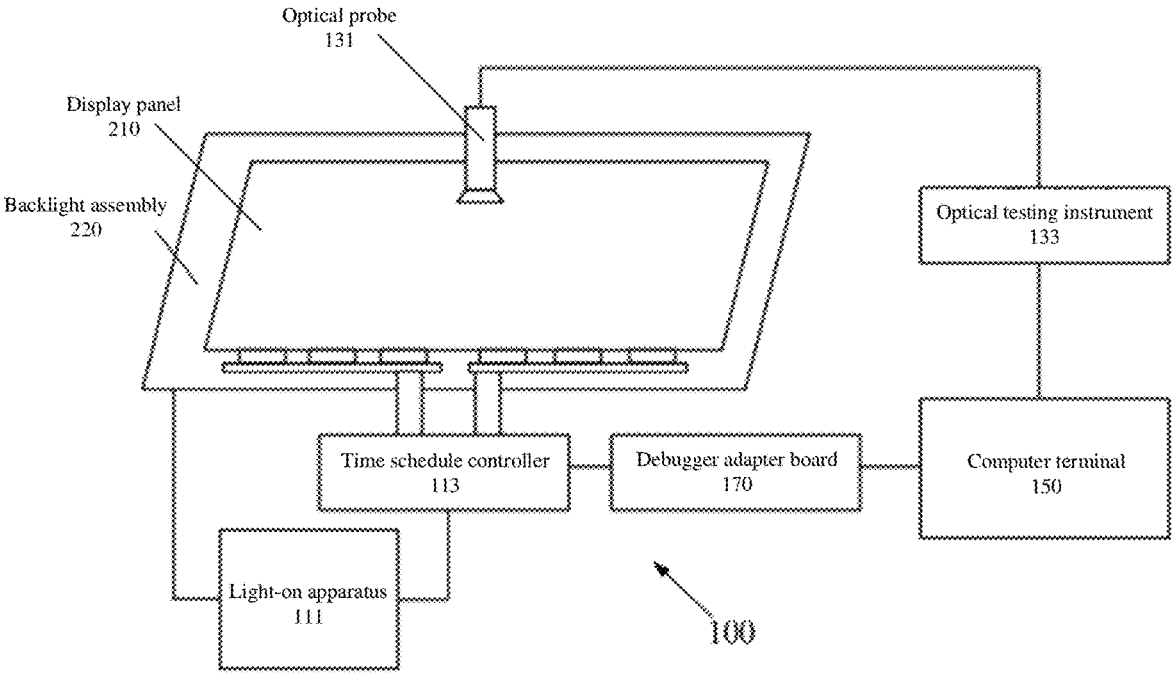
FIG. 4 is a schematic structural diagram of a system for adjusting a common electrode voltage disclosed in the present disclosure.

Reference can be made to FIG. 3 and FIG. 4, where FIG. 3 is a schematic diagram of a connection relationship of a system for adjusting a common electrode voltage disclosed in the present disclosure, and FIG. 4 is a schematic structural diagram of a system for adjusting a common electrode voltage disclosed in the present disclosure. In implementations of the present disclosure, a system for adjusting a common electrode voltage 100 is used to eliminate horizontal crosstalk (i.e., linear Mura illustrated in FIG. 2) of a display device 200. The display device 200 includes a display panel 210 and a backlight assembly 220, the display panel 210 is located at a light-exiting side of the backlight assembly 220, and the backlight assembly 220 is configured to provide backlights for the display panel 210.

In implementations of the present disclosure, the system for adjusting the common electronic voltage 100 may at least include an image generation subsystem 110, an optical metrology subsystem 130, and a computer terminal 150. The computer terminal 150 is electrically connected with the optical metrology subsystem 130 and the image generation subsystem 110, and the display device 200 is electrically connected with the image generation subsystem 110. The image generation subsystem 110 is configured to receive a test-image signal from the computer terminal 150 and transmit the test-image signal received to the display device 200. The display device 200 is configured to receive the test-image signal and display a corresponding test image according to the test-image signal.

The optical metrology subsystem 130 is configured to measure a brightness value of the test image and send the brightness value to the computer terminal 150. The computer terminal 150 is configured to receive the brightness value sent by the optical metrology subsystem 130, and analyze and process the brightness value to determine a target common electrode voltage of the display device 200.

In implementations of the present disclosure, the test-image signal may include a first-test-image signal, a second-test-image signal, and a third-test-image signal. Accordingly, the test image includes a first test image, a second test image, and a third test image.

As illustrated in FIG. 3 and FIG. 4, in implementations of the present disclosure, the image generation subsystem 110 is configured to control the display device 200 to display the test image, and the image generation subsystem 110 may at least include a light-on apparatus 111 and a time schedule controller 113. The time schedule controller 113 is electrically connected with the computer terminal 150, the display panel 210 of the display device 200, and the light-on apparatus 111. The light-on apparatus 111 is electrically connected with the backlight assembly 220 of the display device 200. The light-on apparatus 111 is configured to receive the test-image signal and turn on the backlight assembly 220 according to the test-image signal received. The backlight assembly 220 is configured to provide backlights for the display panel 210 according to the test-image signal. The time schedule controller 113 is configured to adjust the common electrode voltage.

In implementations of the present disclosure, the optical metrology subsystem 130 is configured to measure the brightness value of the test image and send the brightness value to the computer terminal 150. The optical metrology subsystem 130 may at least include an optical probe 131 and an optical testing instrument 133. The optical testing instrument 133 is electrically connected with the computer terminal 150 and the optical probe 131.

In implementations of the present disclosure, the optical probe 131 is configured to sense an optical signal of a test image displayed on the display panel 210 and transmit the optical signal to the optical testing instrument 133. The optical testing instrument 133 is configured to receive the optical signal, obtain the brightness value of the test image according to the optical signal, and send the brightness value to the computer terminal 150.

It can be understood that the optical probe 131 may be in contact with the display panel 210, or spaced apart from the display panel 210 by a preset distance, as long as the optical probe 131 is able to sense the optical signal from the display panel 210, which is not specifically limited in the present disclosure.

In implementations of the present disclosure, as illustrated in FIG. 4, the optical probe 131 is located at a display side of the display panel 210 and is spaced apart from the display panel 210 by the preset distance, and the optical probe 131 can be ensured to better sense the optical signal of the display panel 210 by the preset distance.

In implementations of the present disclosure, the computer terminal 150 is configured to send the test-image signal to the image generation subsystem 110, and the computer terminal 150 is also configured to analyze and process the brightness value of the test image sent by the optical testing instrument 133 to determine the common electrode voltage of the display device 200.

It can be understood that the computer terminal 150 can analyze and process the brightness value of the test image to determine the common electrode voltage of the display device, which is a mature technical means and will not specifically described in the present disclosure.

In implementations of the present disclosure, the system for adjusting the common electronic voltage 100 may also include a debugger adapter board 170. The debugger adapter board 170 is connected between the computer terminal 150 and the time schedule controller 113, so as to realize signal transmission between the computer terminal 150 and the time schedule controller 113.

Figure 5:
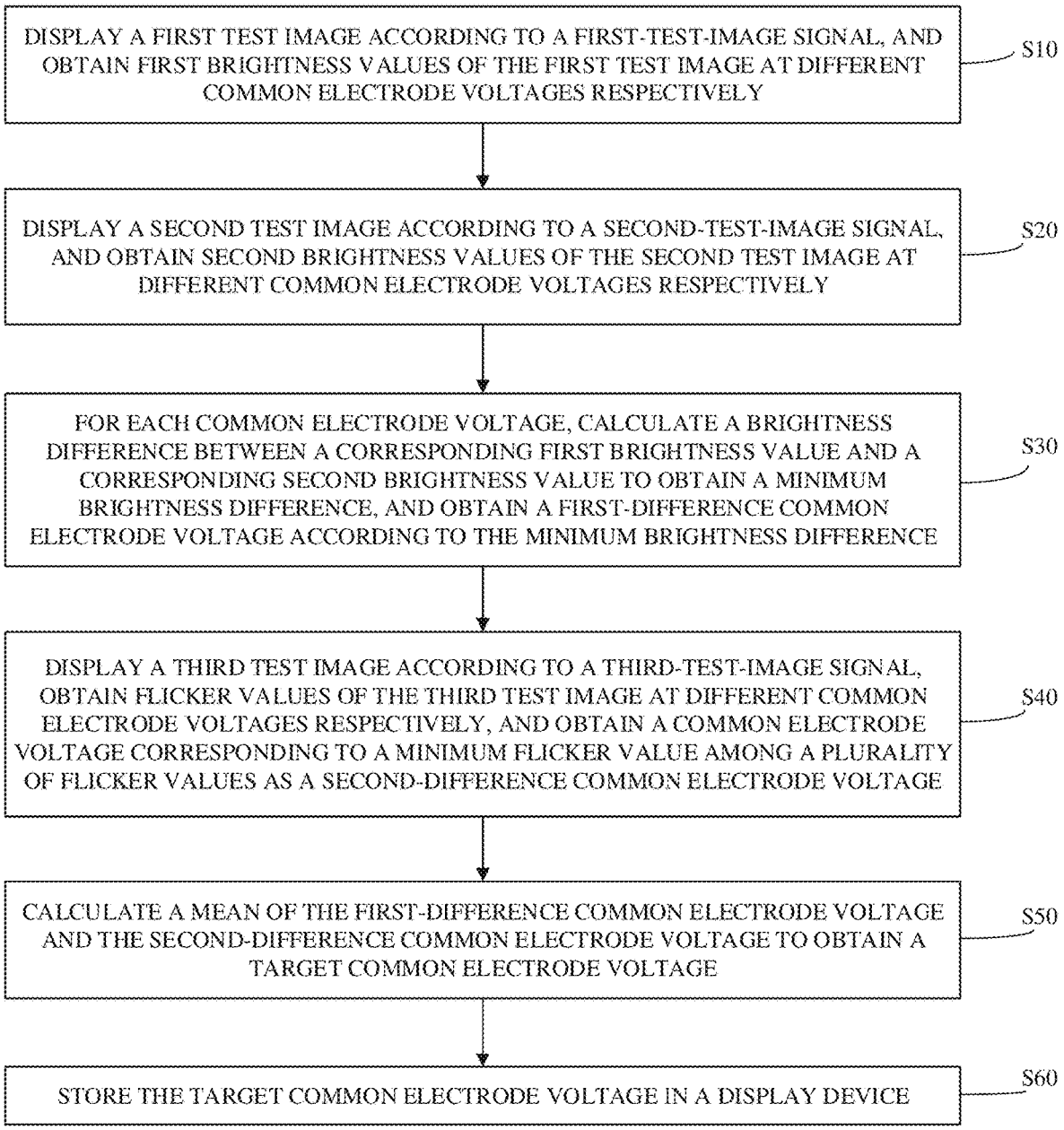
FIG. 5 is a flowchart of a method for eliminating horizontal crosstalk disclosed in implementations of the present disclosure.
Figure 6:
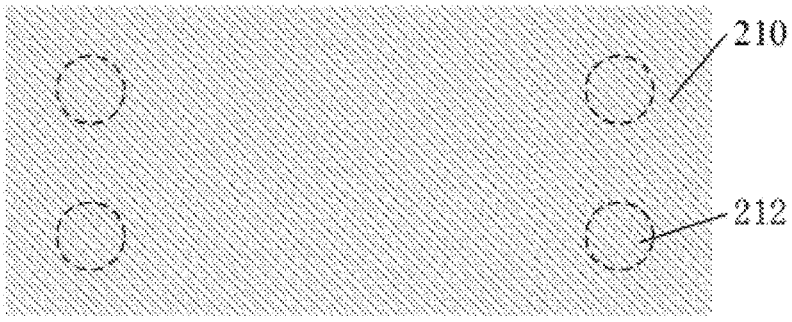
FIG. 6 is a schematic display diagram of a first test image involved in a method for eliminating horizontal crosstalk disclosed in implementations of the present disclosure.

Reference can be made to FIG. 5 and FIG. 6, where FIG. 5 is a flowchart of a method for eliminating horizontal crosstalk disclosed in implementations of the present disclosure, and FIG. 6 is a schematic display diagram of a first test image involved in a method for eliminating horizontal crosstalk disclosed in implementations of the present disclosure. In implementations of the present disclosure, a method for eliminating horizontal crosstalk is performed by the system for adjusting the common electrode voltage illustrated in the above FIG. 3 and FIG. 4, so as to eliminate or reduce the horizontal crosstalk on the display panel. Reference can be made to FIG. 3 and FIG. 4 together, and as illustrated in FIG. 5, the method for eliminating the horizontal crosstalk provided in implementations of the present disclosure may at least include the following.

At S10, a corresponding first test image is displayed according to a first-test-image signal, and first brightness values of the first test image are obtained at different common electrode (i.e., VCOM) voltages respectively.

In implementations of the present disclosure, the first test image displays as a first grayscale image.

Specifically, in implementations of the present disclosure, the display device 200 displays the corresponding first test image according to the first-test-image signal received, and the optical metrology subsystem 130 measures the first brightness values of the first test image at different common electrode voltages respectively. The first test image may refer to the first grayscale image, and the first-test-image signal may refer to a first grayscale-image-signal. Specifically, the first grayscale image may refer to a display image with a grayscale value between 63 and 127.

Figure 7:
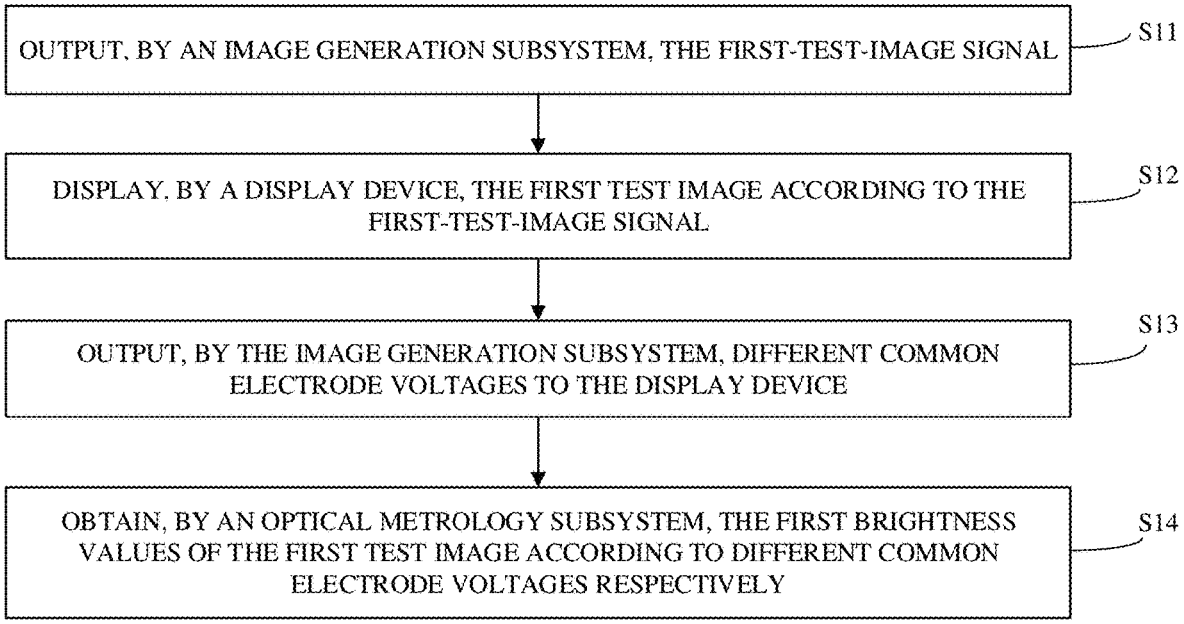
FIG. 7 is a flowchart of an operation at S10 in a method for eliminating horizontal crosstalk disclosed in implementations of the present disclosure.

Reference can be made to FIG. 7, which is a flowchart of an operation at S10 in a method for eliminating horizontal crosstalk disclosed in implementations of the present disclosure. Specifically, in implementations of the present disclosure, the operation at S10 may include at least the following.

At S11, the image generation subsystem 110 outputs the first-test-image signal.

At S12, the display device 200 displays the first test image according to the first-test-image signal.

In implementations of the present disclosure, the image generation subsystem 110 outputs the first-test-image signal and then transmits the first-test-image signal to the display device 200, the display device 200 receives the first-test-image signal and displays the first test image according to the first-test-image signal received. Specifically, the light-on apparatus 111 of the image generation subsystem 110 receives the first-test-image signal and turns on the backlight assembly 220 according to the first-test-image signal received. The backlight assembly 220 provides backlights for the display panel 210 according to the first-test-image signal. Accordingly, the display panel 210 displays the first test image according to the backlights.

At S13, the image generation subsystem 110 outputs different common electrode voltages to the display device 200.

At S14, the optical metrology subsystem 130 obtains the first brightness values of the first test image according to different common electrode voltages respectively.

Specifically, in implementations of the present disclosure, the image generation subsystem 110 can output N different common electrode voltages to the display device 200. The N different common electrode voltages may be, for example: common electrode voltage 1, common electrode voltage 2, common electrode voltage 3, . . . , and common electrode voltage N. The display device 200 displays the first test image at a corresponding common electrode voltage. The optical metrology subsystem 130 detects the first brightness value of the first test image when the display device 200 is at the corresponding common electrode voltage, and then obtains multiple first brightness values corresponding to the N different common electrode voltages respectively. The optical metrology subsystem 130 transmits the multiple first brightness values and the corresponding common electrode voltages to the computer terminal 150.

In implementations of the present disclosure, the time schedule controller 113 can output the N different common electrode voltages to the display panel 210 of the display device 200. The N different common electrode voltages may be, for example: common electrode voltage 1, common electrode voltage 2, common electrode voltage 3, . . . , and common electrode voltage N. The display panel 210 displays the first test image at the corresponding common electrode voltage. The optical probe 131 senses an optical signal of the display panel 210 displaying the first test image at the corresponding common electrode voltage, and then transmits the optical signal to the optical testing instrument 133. The optical testing instrument 133 obtains the multiple first brightness values corresponding to the N different common electrode voltages according to corresponding optical signals respectively. The optical testing instrument 133 transmits the multiple first brightness values and the corresponding common electrode voltages to the computer terminal 150.

It can be understood that the optical probe 131 is in contact with the display panel 210 or spaced apart from the display panel 210 by a preset distance, as long as the optical probe 131 is able to sense the optical signal of the display panel 210, which is not specifically limited in the present disclosure.

As illustrated in FIG. 6, in implementations of the present disclosure, four first test points 212 may be disposed on the display panel 210. The optical probe 131 is used to sense optical signals of the four first test points 212. The optical testing instrument 133 is used to analyze and process four optical signals of the four first test points 212 to obtain the first brightness value. The first brightness value may be a mean of brightness values of the four first test point 212.

It can be understood that in order to ensure accuracy of test data, positions of four test points on the display panel 210 should keep unchanged during test.

In implementations of the present disclosure, common electrode voltage 1, common electrode voltage 2, common electrode voltage 3, . . . , and common electrode voltage N may be N common electrode voltages in a preset common-electrode-voltage range. A midpoint value of the preset common-electrode-voltage range may be a preset common electrode voltage, and a length of the preset common-electrode-voltage range is a preset voltage value. It can be understood that N is a positive integer.

Specifically, the preset common electrode voltage refers to an ideal common electrode voltage which can avoid horizontal crosstalk caused by coupling of parasitic capacitance between the data line and the common electrode. A preset length of the preset common-electrode-voltage range may be 1 volt. It can be understood that the preset voltage value may also be 1.2 volts, 1.4 volts, or other values, which are not specifically limited in the present disclosure.

At S20, a corresponding second test image is displayed according to a second-test-image signal, and second brightness values of the second test image are obtained at different common electrode voltages respectively.

Specifically, in implementations of the present disclosure, the display device 200 displays the corresponding second test image according to the second-test-image signal received. The optical metrology subsystem 130 measures the second brightness values of the second test image at different common electrode voltages respectively.

Figure 8:
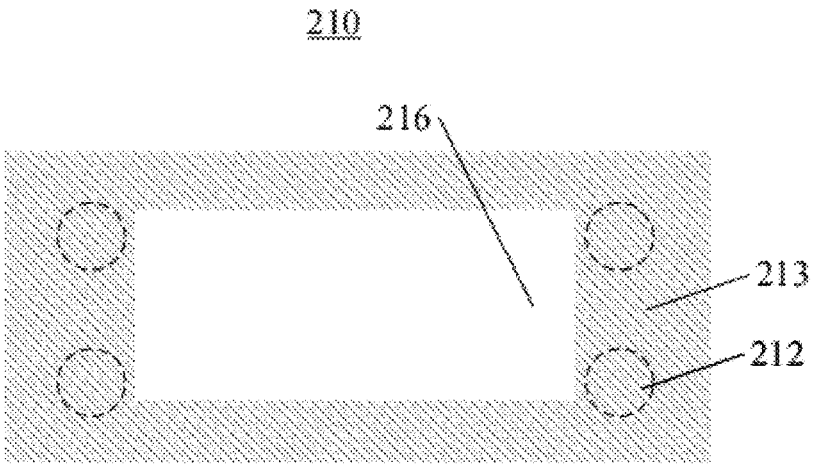
FIG. 8 is a schematic display diagram of a second test image involved in a method for eliminating horizontal crosstalk disclosed in implementations of the present disclosure.

Reference can be made to FIG. 8, which is a schematic display diagram of a second test image involved in a method for eliminating horizontal crosstalk disclosed in implementations of the present disclosure. In implementations of the present disclosure, the second test image has a first test region 213 and a second test region 216, and the first test region 213 is disposed around a peripheral side of the second test region 216. The first test region 213 is used to display a first grayscale image. Specifically, the first grayscale image may refer to a display image with a grayscale value between 63 and 127. Four first test points 212 are disposed on the first test region 213 of the display panel 210, and four test points are used to obtain the second brightness values. The second test region 216 is used to display a second grayscale image. The second grayscale image may refer to a pure-white display image with the maximum grayscale value, that is, the grayscale value of the second grayscale image may be 255.

In implementations of the present disclosure, the second test region 216 is in contrast to the first test region 213, and the first test region 213 and the second test region 216 are used to contrast a coupling condition between the common electrode voltage and the data signal at a first grayscale with a coupling condition between the common electrode voltage and the data signal at a second grayscale, that is, the first test region 213 and the second test region 216 are used to contrast horizontal-crosstalk conditions at different grayscales.

It can be understood that according to a contrast between the second test region 216 and the first test region 213, a theoretical value of the ideal common electrode voltage which can avoid horizontal crosstalk (the theoretical value can be used as the preset common electrode voltage) is calculated.

It can be understood that the first brightness values obtained at S10 and the second brightness values obtained at S20 are used to compare and determine horizontal-crosstalk degrees, so the N common electrode voltages at S10 and S20 should keep consistent.

Figure 9:
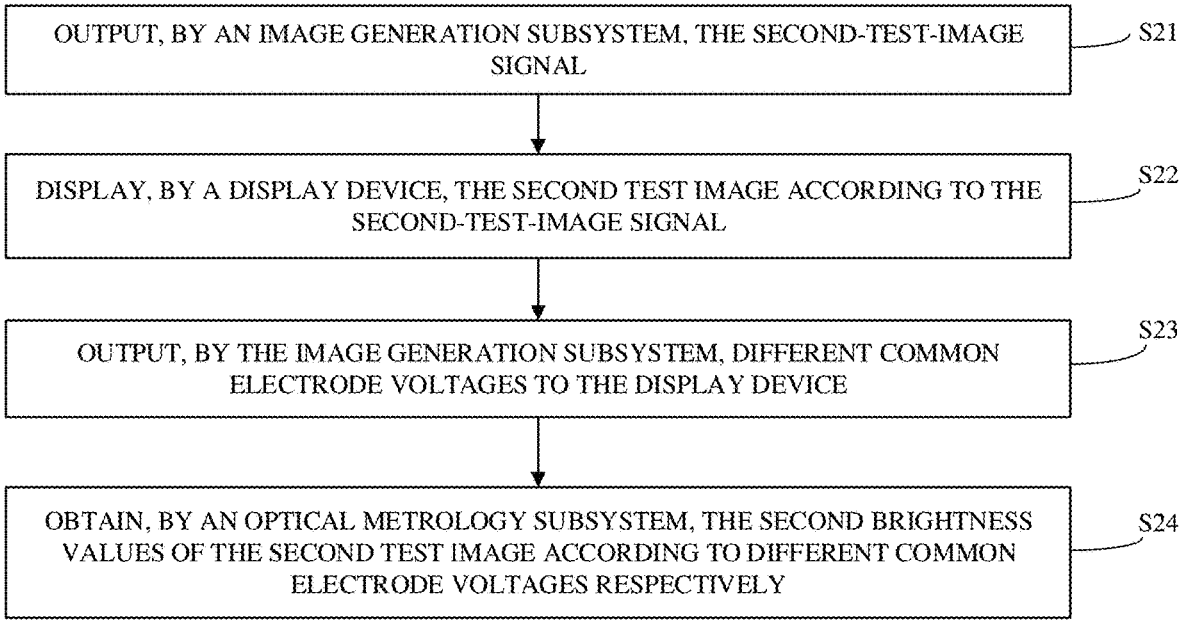
FIG. 9 is a flowchart of an operation at S20 in a method for eliminating horizontal crosstalk disclosed in implementations of the present disclosure.

Reference can be made to FIG. 9, which is a flowchart of an operation at S20 in a method for eliminating horizontal crosstalk disclosed in implementations of the present disclosure. Specifically, in implementations of the present disclosure, the operation at S20 may at least include the following.

At S21, the image generation subsystem 110 outputs the second-test-image signal.

At S22, the display device 200 displays the second test image according to the second-test-image signal.

Specifically, in implementations of the present disclosure, the image generation subsystem 110 outputs the second-test-image signal and then transmits the second-test-image signal to the display device 200. The display device 200 receives the second-test-image signal and displays the second test image according to the second-test-image signal received. Specifically, the light-on apparatus 111 of the image generation subsystem 110 receives the second-test-image signal and turn on the backlight assembly 220 according to the second-test-image signal received. The backlight assembly 220 provides backlights for the display panel 210 according to the second-test-image signal. Accordingly, the display panel 210 displays the second test image according to the backlights.

At S23, the image generation subsystem 110 outputs different common electrode voltages to the display device 200.

At S24, the optical metrology subsystem 130 obtains the second brightness value of the second test image according to different common electrode voltages respectively.

Specifically, in implementations of the present disclosure, the image generation subsystem 110 may output N different common electrode voltages to the display device 200. The N different common electrode voltages may be, for example: common electrode voltage 1, common electrode voltage 2, common electrode voltage 3, . . . , and common electrode voltage N. The display device 200 displays the second test image at a corresponding common electrode voltage. The optical metrology subsystem 130 detects the second brightness value of the second test image when the display device 200 is at the corresponding common electrode voltage, and then obtains multiple second brightness values corresponding to the N different common electrode voltages respectively. The optical metrology subsystem 130 transmits the multiple second brightness values and the corresponding common electrode voltages to the computer terminal 150.

In implementations of the present disclosure, the time schedule controller 113 can output the N different common electrode voltages to the display device 200. The N different common electrode voltages may be, for example: common electrode voltage 1, common electrode voltage 2, common electrode voltage 3, . . . , and common electrode voltage N. The display panel 210 displays the second test image at the corresponding common electrode voltage. The optical probe 131 senses an optical signal of the display panel 210 displaying the second test image at the corresponding common electrode voltage, and then the optical testing instrument 133 obtains the multiple second brightness values corresponding to the N different common electrode voltages according to corresponding optical signals respectively. The optical testing instrument 133 transmits the multiple second brightness values and the corresponding common electrode voltages to the computer terminal 150.

It can be understood that as illustrated in FIG. 8, four first test points 212 are disposed on the display panel 210. The optical probe 131 is used to sense optical signals of the four first test points 212. The optical testing instrument 133 is used to analyze and process four optical signals of the four first test points 212 to obtain the second brightness value. The second brightness value may be a mean of brightness values of the four first test point 212.

At S30, for each common electrode voltage, a brightness difference between a corresponding first brightness value and a corresponding second brightness value is calculated to obtain a minimum brightness difference, and a corresponding first common electrode voltage is obtained according to the minimum brightness difference. The first common electrode voltage may also be referred to a first-difference common electrode voltage.

In implementations of the present disclosure, for each common electrode voltage, an absolute value of a brightness difference between the corresponding first brightness value and the corresponding second brightness value is calculated. A brightness difference with a minimum absolute value among absolute values of multiple brightness differences is recorded as the minimum brightness difference. In other words, the minimum brightness difference among absolute values of multiple brightness differences is recorded. The corresponding first common electrode voltage is obtained according to the minimum brightness difference. Specifically, for each of common electrode voltage 1, common electrode voltage 2, common electrode voltage 3, . . . , and common electrode voltage N, the computer terminal 150 calculates an absolute value of a brightness difference between a corresponding first brightness value and a corresponding second brightness value, and records the brightness difference with the minimum absolute value among the absolute values of the multiple brightness differences as the minimum brightness difference. A common electrode voltage corresponding to the minimum brightness difference is denoted as the first common electrode voltage.

In implementations of the present disclosure, the whole first test image displays as a grayscale image with the same grayscale, and a phenomenon that horizontal crosstalk occurs when coupling of parasitic capacitance between the data line and the common electrode exist due to different grayscales does not exist. The second test image has the first test region 213 and the second test region 216. Since a grayscale value of a display image of the first test region 213 is different from a grayscale value of a display image of the second test region 216, horizontal crosstalk may occur when coupling of the parasitic capacitive between the data lines and the common electrodes exists.

In the technical solution of the present disclosure, brightness values (i.e., first brightness values) of a display image corresponding to different common electrode voltages are recorded when no horizontal crosstalk occurs (i.e., the first test image is displayed), and brightness values (i.e., second brightness values) of a display image corresponding to different common electrode voltages are recorded when horizontal crosstalk occurs (i.e., the second test image is displayed). By comparing absolute values, horizontal-crosstalk degrees caused by parasitic capacitive coupling between the data line and the common electrode can be obtained at different common electrode voltages, where each of the absolute values is an absolute value of a difference between a first brightness value and a second brightness at the same common electrode voltage. When an absolute value is greater, a horizontal-crosstalk degree is greater, and then the first common electrode voltage corresponding to a minimum horizontal-crosstalk degree is obtained.

At S40, a corresponding third test image is displayed according to a third-test-image signal. Flicker values of the third test image are obtained at different common electrode voltages respectively. A common electrode voltage corresponding to a minimum flicker value among multiple flicker values is obtained as a second common electrode voltage. The second common electrode voltage may also be referred to a second-difference common electrode voltage.

In implementations of the present disclosure, the third test image displays as a first grayscale image. The third test image is used to detect flicker values of the display panel 210 at different common electrode voltages, so as to obtain the common electrode voltage corresponding to the minimum flicker value. The common electrode voltage is denoted as the second common electrode voltage.

Figure 10:
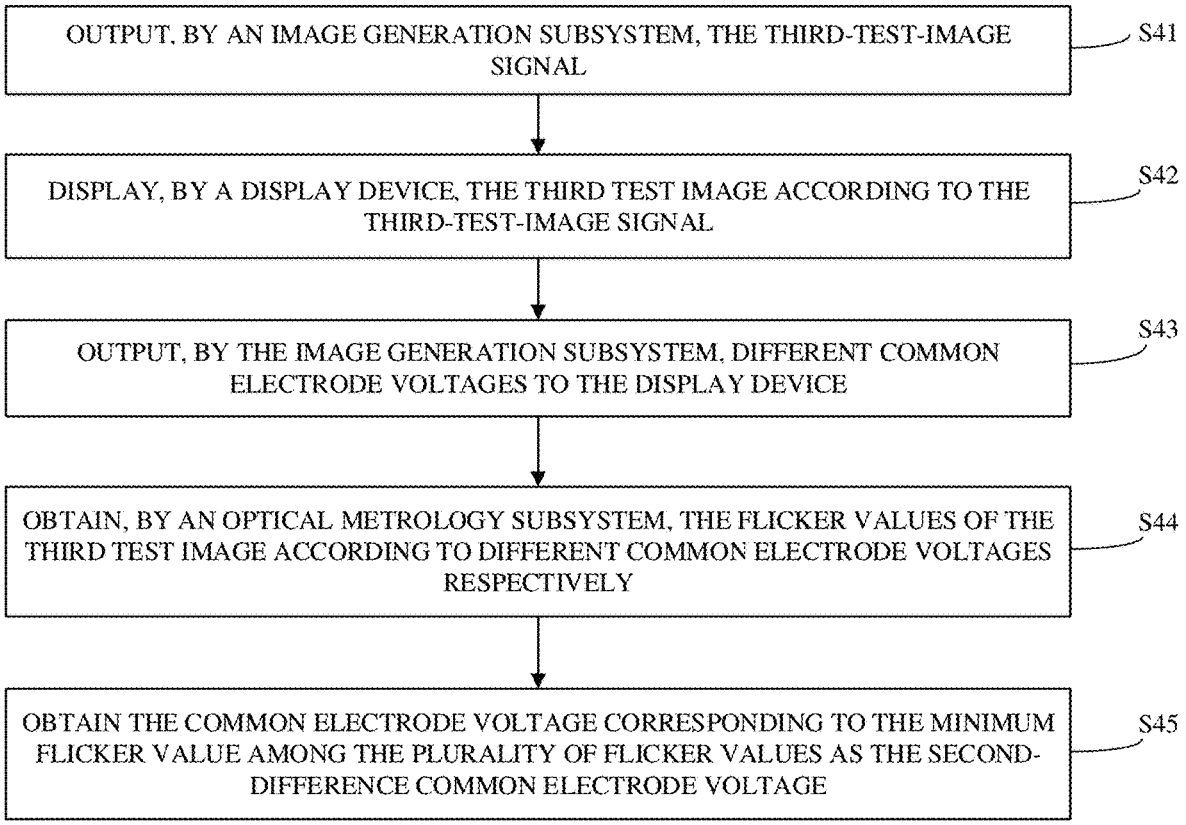
FIG. 10 is a flowchart of an operation at S40 in a method for eliminating horizontal crosstalk disclosed in implementations of the present disclosure.
Figure 11:
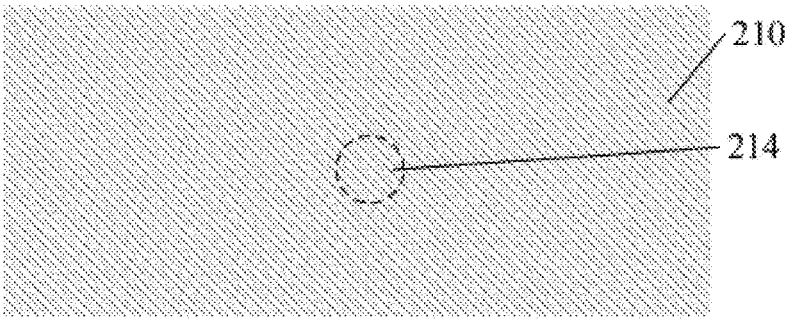
FIG. 11 is a schematic display diagram of a third test image involved in a method for eliminating horizontal crosstalk disclosed in implementations of the present disclosure.

Reference can be made to FIG. 10 and FIG. 11, where FIG. 10 is a flowchart of an operation at S40 in a method for eliminating horizontal crosstalk disclosed in implementations of the present disclosure, and FIG. 11 is a schematic display diagram of a third test image involved in a method for eliminating horizontal crosstalk disclosed in implementations of the present disclosure. In implementations of the present disclosure, the operation at S40 may at least include the following.

At S41, the image generation subsystem 110 outputs the third-test-image signal.

At S42, the display device 200 displays the third test image according to the third-test-image signal.

In implementations of the present disclosure, the image generation subsystem 110 outputs the third-test-image signal and then transmits the third-test-image signal to the display device 200. The display device 200 receives the third-test-image signal and displays the third test image according to the third-test-image signal received. Specifically, the light-on apparatus 111 of the image generation subsystem 110 receives the third-test-image signal and turns on the backlight assembly 220 according to the third-test-image signal received. The backlight assembly 220 provides backlights for the display panel 210 according to the third-test-image signal. Accordingly, the display panel 210 displays the third test image according to the backlights.

At S43, the image generation subsystem 110 outputs different common electrode voltages to the display device 200.

At S44, the optical metrology subsystem 130 obtains the flicker values of the third test image according to different common electrode voltages respectively.

Specifically, in implementations of the present disclosure, the image generation subsystem 110 may output N different common electrode voltages to the display device 200. The N different common electrode voltages may be, for example: common electrode voltage 1, common electrode voltage 2, common electrode voltage 3, . . . , and common electrode voltage N. The display device 200 displays the third test image at a corresponding common electrode voltage. The optical metrology subsystem 130 detects the flicker value of the third test image when the display device 200 is at the corresponding common electrode voltage, and then obtains multiple flicker values corresponding to the N different common electrode voltages respectively. The optical metrology subsystem 130 transmits the multiple flicker values and the corresponding common electrode voltages to the computer terminal 150.

In implementations of the present disclosure, the time schedule controller 113 can output the N different common electrode voltages to the display device 200. The N different common electrode voltages may be, for example: common electrode voltage 1, common electrode voltage 2, common electrode voltage 3, . . . , and common electrode voltage N. The display panel 210 displays the third test image at the corresponding common electrode voltage. The optical probe 131 senses an optical signal of the display panel 210 displaying the third test image at the corresponding common electrode voltage, and then the optical testing instrument 133 obtains the multiple flicker values corresponding to the N different common electrode voltages according to corresponding optical signals respectively. The optical testing instrument 133 transmits the multiple flicker values and the corresponding common electrode voltages to the computer terminal 150.

In implementations of the present disclosure, one second test point 214 may be disposed on the display panel 210. The optical probe 131 is used to sense an optical signal of the second test point 214. The optical testing instrument 133 is used to analyze and process the optical signal of the second test point 214 to obtain the flicker value.

At S45, the common electrode voltage corresponding to the minimum flicker value among the multiple flicker values is obtained as the second common electrode voltage.

In implementations of the present disclosure, the multiple flicker values are compared with a preset flicker value respectively. The minimum flicker value among the plurality of flicker values is obtained according to a comparison result. The second common electrode voltage is obtained according to the minimum flicker value. Specifically, the computer terminal 150 compares the multiple flicker values received with the preset flicker value, to obtain the common electrode voltage corresponding to a flicker value closest to the preset flicker value (an absolute value of a difference between the flicker value and the preset flicker value is the minimum), and the common electrode voltage is denoted as the second common electrode voltage. The preset flicker value is an ideal flicker value, that is, a reference value for magnitude comparison with the multiple flicker values.

At S50, a mean of the first common electrode voltage and the second common electrode voltage is calculated to obtain a target common electrode voltage.

In implementations of the present disclosure, the second common electrode voltage refers to the common electrode voltage corresponding to the minimum flicker value among the multiple flicker values of the display device 200.

In implementations of the present disclosure, the computer terminal 150 may include an operation program. The computer terminal 150 can analyze and process the first common electrode voltage and the second common electrode voltage to obtain the target common electrode voltage.

In implementations of the present application, compared with determining a VCOM voltage solely according to an image flicker condition or adjusting a VCOM voltage solely according to a horizontal-crosstalk degree, an influence of horizontal crosstalk and image flicker on an image quality of the display device 200 is simultaneously considered in the present disclosure, which avoids reliability of the display device 200 from being affected due to a VCOM voltage corresponding to a minimum horizontal-crosstalk degree being different from a VCOM voltage corresponding to minimum image flicker, such that the reliability of the display device is effectively ensured, and the display effect and the display quality of the display device are improved.

In implementations of the present disclosure, the method for eliminating horizontal crosstalk may further include the following.

At S60, the target common electrode voltage is stored in the display device 200.

In implementations of the present disclosure, the display device 200 may also include a backlight control part (not illustrated). The backlight control part includes a Read-Only Memory (ROM). The target VCOM voltage may be stored in the ROM and as a reference voltage (common electrode voltage) for driving the display panel to display different images.

Based on the same inventive concept, a display device 200 is further provided in the present disclosure. The display device 200 includes a display panel 210 and a backlight assembly 220. The display panel 210 is mounted at a light-exiting side of the backlight assembly 220. The backlight assembly 220 is configured to provide backlights for the display panel 210. The display device 200 is configured to determine a common electrode voltage for driving the display panel 210 according to the above method for eliminating the horizontal crosstalk.

It can be understood that the display device provided in implementations of the present disclosure may be any products or components with display functions such as a notebook-computer display screen, a liquid crystal display, a liquid crystal television, a mobile phone, a tablet computer, etc.

In implementations, the display device 200 further includes other necessary components such as a power supply board, a high voltage board, a button control panel, etc., which can be supplemented by those skilled in the art according to specific types and actual functions of the display device 200, and will not be repeated herein.

It can be understood that that the display device 200 may also be applied to electronic devices with functions such as a Personal Digital Assistant (PDA) and/or a music player, such as a mobile phone, a tablet computer, a wearable electronic device with a wireless communication function (e.g., a smart watch), etc. The above electronic device may also be other electronic devices such as a laptop computer (Laptop) with a touch-sensitive surface (e.g., a touch panel) or the like.

To sum up, as for the method for eliminating the horizontal crosstalk, the system for adjusting the common electrode voltage, and the display device which are provided in the present disclosure, the display device 200 can display the first test image and the second test image at multiple common electrode voltages respectively, detect first brightness values of the first test image corresponding to different common electrode voltages and second brightness values of the second test image corresponding to different common electrode voltages, and determine the first common electrode voltage corresponding to a minimum horizontal-crosstalk degree by comparing corresponding first brightness values and corresponding second brightness values. An influence of image flicker on the image quality of the display device is considered, and the VCOM voltage of the display device is finally determined according to the first common electrode voltage and the second common electrode voltage corresponding a minimum image flicker, which effectively avoids the phenomenon that when the voltage of the data line changes, the display image is prone to horizontal crosstalk since the common electrode voltage is affected by the coupling between the parasitic capacitance and the common electrode, such that the display effect and quality of the display device 200 is greatly improved. In the meanwhile, a relationship between an influence of horizontal crosstalk on the common electrode voltage and an influence of image flicker on the common electrode voltage is comprehensively considered in the technical solution, such that the reliability of the display device 200 is greatly improved.

All possible combinations of respective technical features in the above implementations are described. However, as long as there is no contradiction in the combinations of these technical features, the combinations of these technical features should be considered to be within the scope of the present specification.

The above implementations only show several implementations of the present disclosure, and the descriptions thereof are relatively specific and detailed, but cannot be understood as a limitation to the scope of the present disclosure. It should be noted that for those of ordinary skill in the art, without departing from the concept of the present disclosure, several modifications and improvements can be made, and these all belong to the protection scope of the present disclosure. Therefore, the protection scope of the present disclosure shall be referred to the appended claims.

What is claimed is:

1. A method for eliminating horizontal crosstalk, comprising:

displaying a corresponding first test image according to a first-test-image signal, and obtaining first brightness values of the first test image at different common electrode voltages respectively;

displaying a corresponding second test image according to a second-test-image signal, and obtaining second brightness values of the second test image at different common electrode voltages respectively;

for each common electrode voltage, calculating a brightness difference between a corresponding first brightness value and a corresponding second brightness value to obtain a minimum brightness difference, and obtaining a corresponding first-difference common electrode voltage according to the minimum brightness difference;

displaying a corresponding third test image according to a third-test-image signal, obtaining flicker values of the third test image at different common electrode voltages respectively, and obtaining a common electrode voltage corresponding to a minimum flicker value among a plurality of flicker values as a second-difference common electrode voltage; and calculating a mean of the first-difference common electrode voltage and the second-difference common electrode voltage to obtain a target common electrode voltage.

2. The method for eliminating the horizontal crosstalk of claim 1, wherein displaying the corresponding first test image according to the first-test-image signal, and obtaining the first brightness values of the first test image at different common electrode voltages respectively comprises:

outputting, by an image generation subsystem, the first-test-image signal;

displaying, by a display device, the first test image according to the first-test-image signal;

outputting, by the image generation subsystem, different common electrode voltages to the display device; and obtaining, by an optical metrology subsystem, the first brightness values of the first test image according to different common electrode voltages respectively.

3. The method for eliminating the horizontal crosstalk of claim 1, wherein displaying the corresponding second test image according to the second-test-image signal, and obtaining the second brightness values of the second test image at different common electrode voltages respectively comprises:

outputting, by an image generation subsystem, the second-test-image signal;

displaying, by a display device, the second test image according to the second-test-image signal;

outputting, by the image generation subsystem, different common electrode voltages to the display device; and obtaining, by an optical metrology subsystem, the second brightness values of the second test image according to different common electrode voltages respectively.

4. The method for eliminating the horizontal crosswalk of claim 1, wherein for each common electrode voltage, calculating the brightness difference between the corresponding first brightness value and the corresponding second brightness value to obtain the minimum brightness difference, and obtaining the corresponding first-difference common electrode voltage according to the minimum brightness difference comprises:

for each common electrode voltage, calculating an absolute value of a brightness difference between the corresponding first brightness value and the corresponding second brightness value;

recording the minimum brightness difference among absolute values of a plurality of brightness differences; and obtaining the corresponding first-difference common electrode voltage according to the minimum brightness difference.

5. The method for eliminating the horizontal crosswalk of claim 1, wherein displaying the corresponding third test image according to the third-test-image signal, obtaining the flicker values of the third test image at different common electrode voltages respectively, and obtaining the common electrode voltage corresponding to the minimum flicker value among the plurality of flicker values as the second-difference common electrode voltage comprises:

outputting, by an image generation subsystem, the third-test-image signal;

displaying, by a display device, the third test image according to the third-test-image signal;

outputting, by the image generation subsystem, different common electrode voltages to the display device;

obtaining, by an optical metrology subsystem, the flicker values of the third test image according to different common electrode voltages respectively; and obtaining the common electrode voltage corresponding to the minimum flicker value among the plurality of flicker values as the second-difference common electrode voltage.

6. The method for eliminating the horizontal crosstalk of claim 5, wherein obtaining the common electrode voltage corresponding to the minimum flicker value among the plurality of flicker values as the second-difference common electrode voltage comprises:

comparing the plurality of flicker values with a preset flicker value respectively;

obtaining the minimum flicker value among the plurality of flicker values according to a comparison result; and obtaining the second-difference common electrode voltage according to the minimum flicker value.

7. The method for eliminating the horizontal crosstalk of claim 1, wherein the first test image displays as a first grayscale image, and the second test image has a first test region and a second test region, wherein the first test region displays as the first grayscale image, and the second test region displays as a second grayscale image.

8. The method for eliminating the horizontal crosstalk of claim 1, further comprising:

storing the target common electrode voltage in a display device.

9. A system for adjusting a common electrode voltage, for eliminating horizontal crosstalk of a display device and comprising an image generation subsystem, an optical metrology subsystem, and a computer terminal, wherein the image generation subsystem is electrically connected with the computer terminal and the display device, and is configured to receive a test-image signal from the computer terminal and transmit the test-image signal received to the display device, wherein the test-image signal comprises a first test-image signal, a second test-image signal, and a third test-image signal;

the display device is configured to receive the test-image signal, display a corresponding first test image according to the first test-image signal, display a corresponding second test image according to the second test-image signal, display a corresponding third test image according to the third test-image signal;

the optical metrology subsystem is electrically connected with the computer terminal, and is configured to obtain first brightness values of the first test image at different common electrode voltages respectively, obtain second brightness values of the second test image at different common electrode voltages respectively, and flicker values of the third test image at different common electrode voltages respectively, and send the first brightness values, the second brightness values, and the flicker values to the computer terminal; and the computer terminal is configured to receive the first brightness values the second brightness values, and the flicker values sent by the optical metrology subsystem; for each common electrode, calculate a brightness difference between a corresponding first brightness value and a corresponding second brightness value to obtain a minimum brightness difference, and obtain a first-difference common electrode voltage according to the minimum brightness difference; obtain a common electrode voltage corresponding to a minimum flicker value among a plurality of flicker values as a second-difference common electrode voltage; and calculate a mean of the first-difference common electrode voltage and the second-difference common electrode voltage to obtain a common electrode voltage.

10. The system for adjusting the common electrode voltage of claim 9, wherein the image generation subsystem comprises a light-on apparatus and a time schedule controller, the display device comprises a display panel and a backlight assembly, the time schedule controller is electrically connected with the computer terminal, the display panel, and the light-on apparatus, and the light-on apparatus is electrically connected with the backlight assembly.

11. The system for adjusting the common electrode voltage of claim 10, wherein the light-on apparatus is configured to receive the test-image signal and turn on the backlight assembly according to the test-image signal received, the time schedule controller is configured to adjust a common electrode voltage, and the optical metrology subsystem is configured to measure the brightness value of the test image at the common electrode voltage adjusted.

12. The system for adjusting the common electrode voltage of claim 10, wherein the computer terminal is configured to send the test-image signal to the time schedule controller.

13. The system for adjusting the common electrode voltage of claim 9, wherein the optical metrology subsystem comprises an optical probe and an optical testing instrument, and the optical testing instrument is electrically connected between the computer terminal and the optical probe.

14. The system for adjusting the common electrode voltage of claim 13, wherein the optical probe is configured to sense an optical signal of the test image displayed on a display panel of the display device and transmit the optical signal to the optical testing instrument, and the optical testing instrument is configured to receive the optical signal, obtain the brightness value of the test image according to the optical signal, and send the brightness value to the computer terminal.

15. The system for adjusting the common electrode voltage of claim 14, wherein the optical probe is spaced apart from the display panel by a preset distance.

16. The system for adjusting the common electrode voltage of claim 9, further comprising a debugger adapter board, wherein the debugger adapter board is connected between the computer terminal and the time schedule controller.

17. A display device, comprising a display panel and a backlight assembly, wherein the display panel is mounted at a light-existing side of the backlight assembly, the backlight assembly is configured to provide backlights for the display panel, and the display device is configured to:

display a corresponding first test image according to a first-test-image signal, and obtain first brightness values of the first test image at different common electrode voltages respectively;

display a corresponding second test image according to a second-test-image signal, and obtain second brightness values of the second test image at different common electrode voltages respectively;

for each common electrode voltage, calculate a brightness difference between a corresponding first brightness value and a corresponding second brightness value to obtain a minimum brightness difference, and obtain a corresponding first-difference common electrode voltage according to the minimum brightness difference;

display a corresponding third test image according to a third-test-image signal, obtain flicker values of the third test image at different common electrode voltages respectively, and obtain a common electrode voltage corresponding to a minimum flicker value among a plurality of flicker values as a second-difference common electrode voltage; and calculate a mean of the first-difference common electrode voltage and the second-difference common electrode voltage to obtain a target common electrode voltage, to determine a common electrode voltage for driving the display panel.

18. The method for eliminating the horizontal crosstalk of claim 2, further comprising:

storing the target common electrode voltage in a display device.

19. The method for eliminating the horizontal crosstalk of claim 3, further comprising:

storing the target common electrode voltage in a display device.

20. The method for eliminating the horizontal crosstalk of claim 4, further comprising:

storing the target common electrode voltage in a display device.

* * * * *